US007717077B2

(12) United States Patent
Prior

(10) Patent No.: US 7,717,077 B2
(45) Date of Patent: May 18, 2010

(54) INTERNAL COMBUSTION ENGINE STARTING SYSTEM AND METHOD

(75) Inventor: Gregory P. Prior, Birmingham, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 244 days.

(21) Appl. No.: 11/938,908

(22) Filed: Nov. 13, 2007

(65) Prior Publication Data

US 2009/0120397 A1 May 14, 2009

(51) Int. Cl.
*F02D 41/40* (2006.01)
*F02D 41/06* (2006.01)
*F02M 63/02* (2006.01)

(52) U.S. Cl. ..... 123/179.5; 123/179.17; 123/447

(58) Field of Classification Search ..... 123/179.3, 123/179.5, 179.17, 447
See application file for complete search history.

(56) References Cited

U.S. PATENT DOCUMENTS 4,009,695 A * 3/1977 Ule ..... 123/179.5
5,456,233 A * 10/1995 Felhofer ..... 123/447
6,098,585 A * 8/2000 Brehob et al. ..... 123/179.5
6,234,128 B1 * 5/2001 Reuss ..... 123/447
6,497,215 B1 * 12/2002 Gaessler et al. ..... 123/447
6,962,136 B2 11/2005 Hayman
7,082,899 B2 * 8/2006 Hanson et al. ..... 123/179.5
2005/0005912 A1 * 1/2005 Joos et al. ..... 123/458
2006/0169252 A1 * 8/2006 Ludwig et al. ..... 123/447

FOREIGN PATENT DOCUMENTS

DE 03117144 A1 * 11/1982
DE 10246594 A1 * 4/2004

* cited by examiner

*Primary Examiner*—Stephen K Cronin
*Assistant Examiner*—Arnold Castro
(74) *Attorney, Agent, or Firm*—Quinn Law Group, PLLC

(57) ABSTRACT

A starting system is provided for delivering pressurized fuel to an engine to start the engine without a starter. The starting system includes an accumulator for storing pressurized fuel during engine operation and engine shut-down. During engine start-up, the accumulator delivers the stored pressurized fuel to the engine to start the engine. The accumulator is in fluid communication with a low pressure fuel reservoir and the engine. The accumulator includes an accumulator housing defining an accumulator cavity and including an accumulator piston and spring assembly, which is moveable longitudinally within the accumulator cavity. An electronic control module (ECM) is in electronic control with the starting system and the engine. The ECM is operable to activate the accumulator, forcing pressurized fuel stored within the accumulator into a high-pressure fuel line for injection into the engine, to generate at least one starting combustion event to start the engine without a starter.

10 Claims, 5 Drawing Sheets

INTERNAL COMBUSTION ENGINE STARTING SYSTEM AND METHOD

TECHNICAL FIELD

The present invention relates generally to starting systems for internal combustion engines and, more particularly, to an internal combustion engine starting apparatus and method of starting an internal combustion engine that does not require a starter.

BACKGROUND OF THE INVENTION

Internal combustion engines traditionally require a starting system including a starter to start the engine. As is known, when a user activates an ignition circuit, for example by turning a key or pressing an ignition button, the starter is activated. Upon activation, the function of the starter is two fold. First, the starter turns a fuel pump to provide fuel to the engine. Second, the starter cranks the engine creating suction that draws a fuel/air mixture into a cylinder of the engine for combustion.

Traditional Spark Ignited Direct Injection (SIDI) engines have a fuel feed system including a high pressure fuel pump that feeds fuel to the injectors for injection directly into the combustion chamber of the cylinder to be combusted.

During SIDI engine operation, the high pressure fuel pump is driven by the engine during engine operation. However, during engine startup, the starter is required initially to turn the high pressure fuel pump to provide the fuel necessary to start the engine.

As such, it is desirable to provide a starting system for an internal combustion engine that does not require a starter.

SUMMARY OF THE INVENTION

In one example embodiment of the present invention, an internal combustion engine starting system including a fuel accumulator instead of a starter is provided.

A starting system is provided for delivering pressurized fuel to an engine to start the engine without a starter. The starting system includes an accumulator for storing pressurized fuel during engine operation and engine shut-down. During engine start-up, the accumulator delivers the stored pressurized fuel to the engine to start the engine without a starter.

The accumulator is in fluid communication with a low pressure fuel reservoir and the engine. The accumulator includes an accumulator housing that defines an accumulator cavity and includes an accumulator piston and spring assembly, which is moveable longitudinally within the accumulator cavity.

A solenoid, in communication with the accumulator, includes a pawl for engagement with a cavity formed in the accumulator piston. The solenoid is operable to selectively engage/disengage the pawl with/from the cavity formed in the accumulator piston to respectively hold the accumulator piston and spring assembly in a fixed position or to release the accumulator piston and spring assembly to move longitudinally within the accumulator cavity.

A valve is positioned between the low pressure fuel supply and the accumulator.

An electronic control module (ECM) is in electronic communication with the starting system and the engine. The ECM is operable to actuate the valve between an open position, during engine operation, and a closed position, during engine start-up and at engine-shut down.

Upon ignition, the ECM is operable to determine which cylinder within the engine has a firing position closest to but not before a top dead center firing position. Upon such determination, the ECM activates the solenoid to disengage the pawl from the accumulator piston, forcing pressurized fuel stored within the accumulator into a high-pressure fuel line for injection into the determined cylinder of the engine. The ECM then initiates a spark into the determined cylinder to generate at least one starting combustion event to start the engine without a starter.

The benefits of eliminating the starter from the starting system include decreased initial starting system cost, weight and complexity. Likewise, elimination of the starter would remove a known failure mode, thereby decreasing future service cost and improving customer satisfaction.

The above features and advantages of the present invention are readily apparent from the following detailed description of the best modes for carrying out the invention when taken in connection with the accompanying drawings.

DESCRIPTION OF THE PREFERRED EMBODIMENTS

Figure 1:
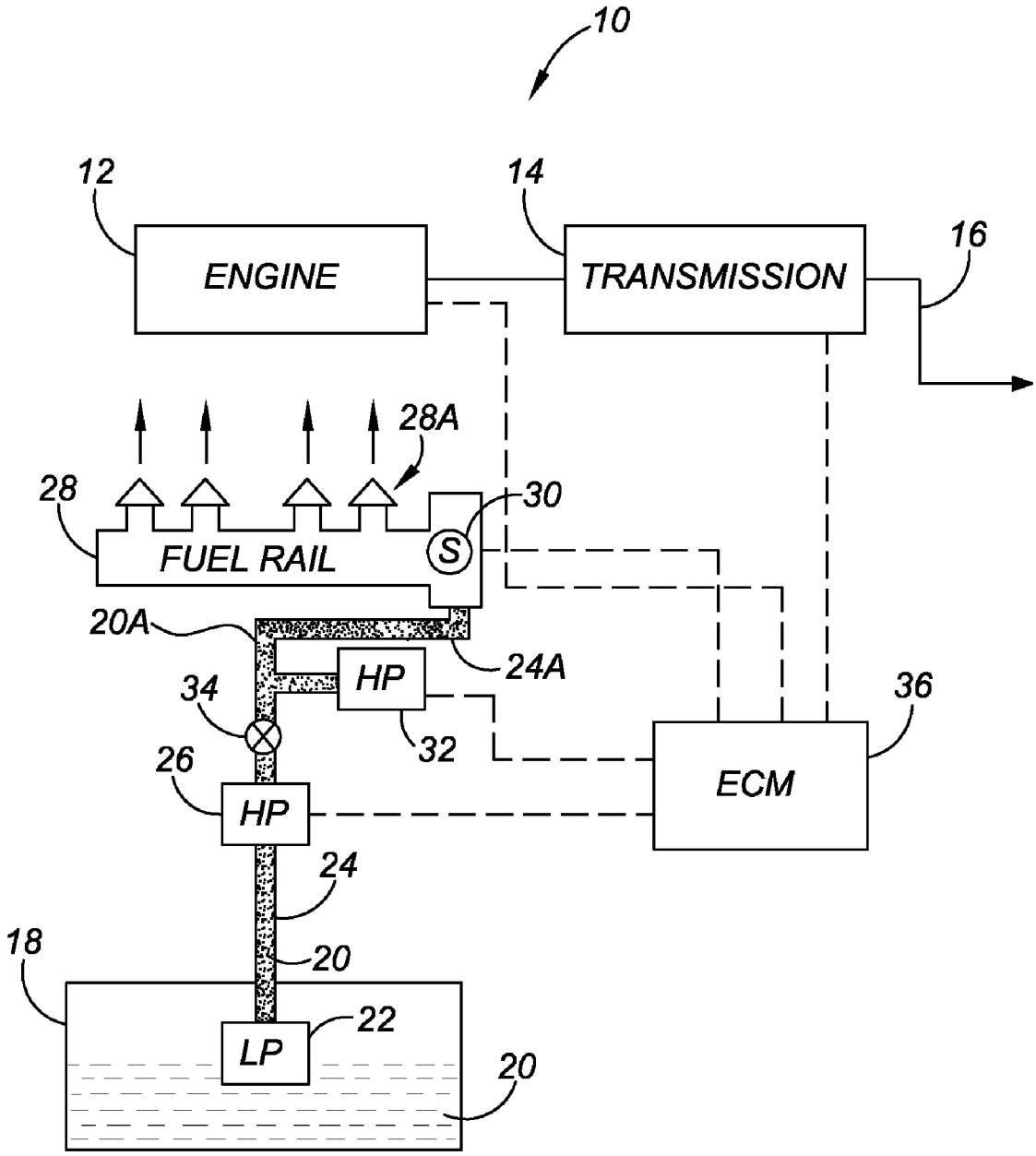
FIG. 1 is a schematic illustration of a vehicle having an internal combustion engine and a starting system including an accumulator according to one embodiment of the present invention.

Referring to the drawings, wherein like reference numbers correspond to like or similar components throughout several figures, in FIG. 1 a vehicle 10 has an engine 12 operatively connected to a transmission 14. Transmission 14 has an output member 16 in driving connection with a plurality of wheels (not shown) for transferring power from the engine 12 to the wheels (not shown) to propel the vehicle 10. Engine 12 may be a Spark Ignited Direct Injection (SIDI) engine, the operation of which is known to those skilled in the art. Engine 12 may be a V-type engine having cylinder bores, not shown, arranged in a V-shaped fashion, or alternately an inline, horizontally opposed, W-type, or other style or design of engine utilizing high-pressure fuel injection.

Vehicle 10 includes a low pressure fuel reservoir or tank 18 containing a combustible supply of fuel 20, for example gasoline. A low-pressure (LP) supply pump 22 is positioned within tank 18 and is operable for moving fuel 20 through a fuel line 24 to a high-pressure (HP) pump assembly 26. HP pump assembly 26 is operable for rapidly pressurizing fuel 20, which is delivered to the HP pump assembly 26 by LP supply pump 22 at, for example, approximately 5 bar, to, for example, approximately 150 to 200 bar. Pressurized fuel 20A is then delivered through a high-pressure fuel line 24A to a fuel rail 28 having at least one fuel pressure sensor 30 adapted for sensing pressure at fuel rail 28. From the fuel rail 28, the pressurized fuel 20A is directly injected into engine 12 by a plurality of fuel injectors 28A.

An accumulator 32 is in fluid communication with the low pressure fuel reservoir 18 and the fuel rail 28. The accumulator 32 receives pressurized fuel 20A from the high-pressure fuel line 24A and stores the pressurized fuel 20A during engine operation. The accumulator continues to store pressurized fuel 20A when the engine 12 is shut-down and is operable to deliver the pressurized fuel 20A to the plurality of injectors 28A during engine start-up as illustrated in further detail in FIG. 3.

In the illustrated embodiment, the pressurized fuel 20A is stored at an elevated pressure; however, alternatively the pressurized fuel 20A can be stored at an ambient pressure.

An electronic control module (ECM) or controller 36 is in electronic communication with the engine 12, the transmission 14, the LP supply pump 22, the HP pump assembly 26, the fuel rail 28, the accumulator 32, and a valve 34 for control and synchronization of the various starting system and fuel supply components.

The valve 34, for example a check valve or a solenoid, is operable to control a flow of pressurized fuel 20A within the high-pressure fuel line 24A. The valve 34 is in an open position during engine operation to allow fuel to flow from the low pressure fuel reservoir 18 to the fuel rail 28 for delivery to the engine 12 by the plurality of fuel injectors 28A. The valve 34 moves to a closed position upon engine shut-down and remains in the closed position when the engine 12 is shut-down to prevent fuel from flowing from the high-pressure fuel line 24A back into the low pressure fuel reservoir 18.

Figure 2:
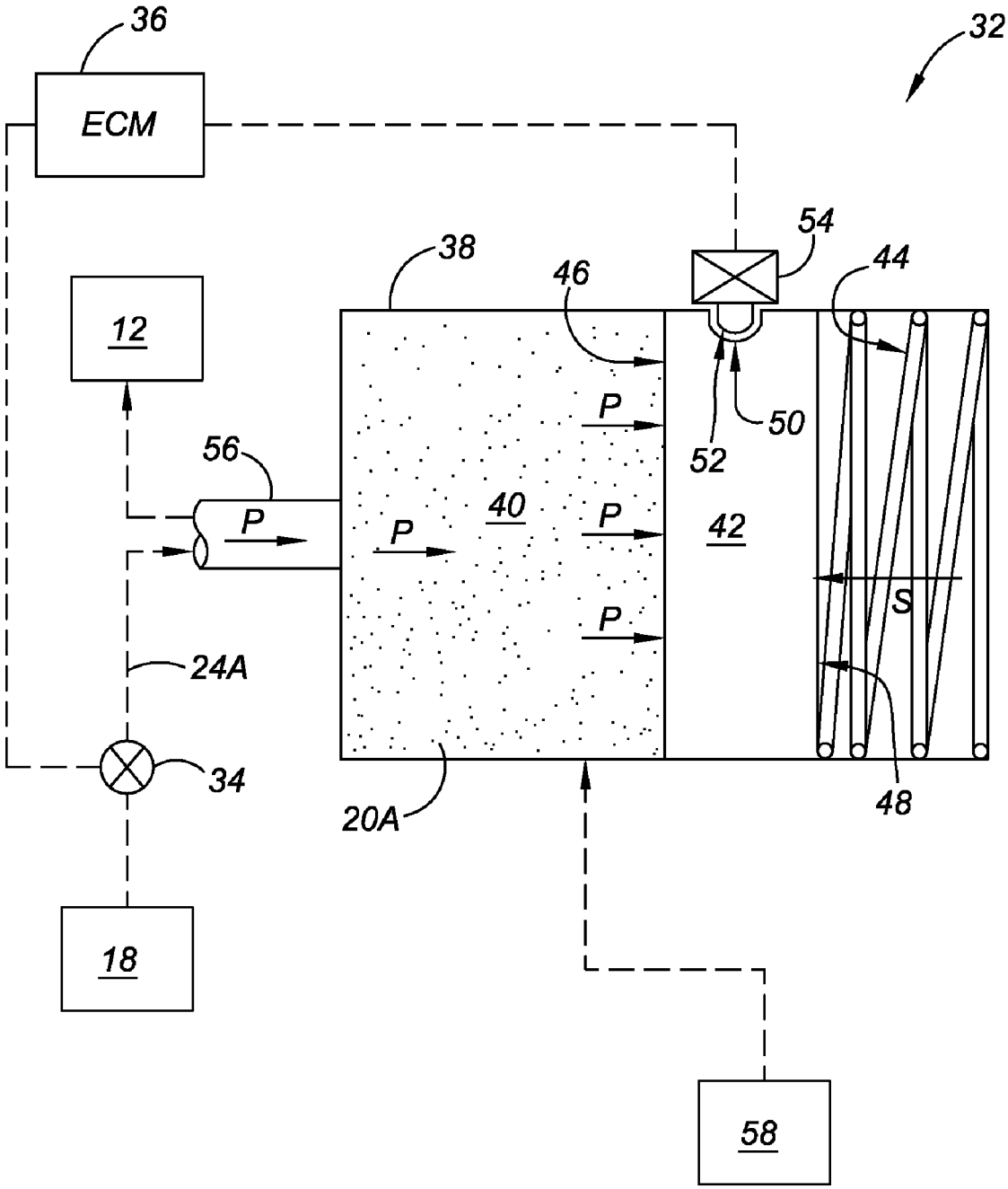
FIG. 2 is a schematic illustration of the starting system for the internal combustion engine including a detailed illustration of the accumulator according to one embodiment of the present invention.

As illustrated in FIG. 2, the accumulator 32 includes an accumulator housing 38 defining an accumulator cavity 40. An accumulator piston 42 and an accumulator spring 44 are disposed within the accumulator housing 38. The accumulator piston 42 includes a pocket 50 for receiving a pawl 52. A solenoid 54 is operable to selectively engage/disengage the pawl 52. When the pawl 52 is engaged, the accumulator piston 42 is secured in a fixed position within the accumulator housing 38. When the pawl 52 is disengaged, the accumulator piston 42 can move longitudinally within the accumulator housing 38.

During engine operation, pressurized fuel 20A enters the accumulator 32 through an inlet/outlet port 56 and exerts a pressure force P against a front face 46 of the accumulator piston 42, compressing the accumulator spring 44, which exerts a spring force S against a rear face 48 of the accumulator piston 42. The pressurized fuel 20A is stored by the accumulator 32 within the accumulator cavity 40.

Additionally, to accommodate initial pre-fill and subsequent service, the accumulator 32 can be filled with pressurized fuel 20A from an external source 58, for example a fuel fill machine on an assembly line (not shown).

Figure 3:
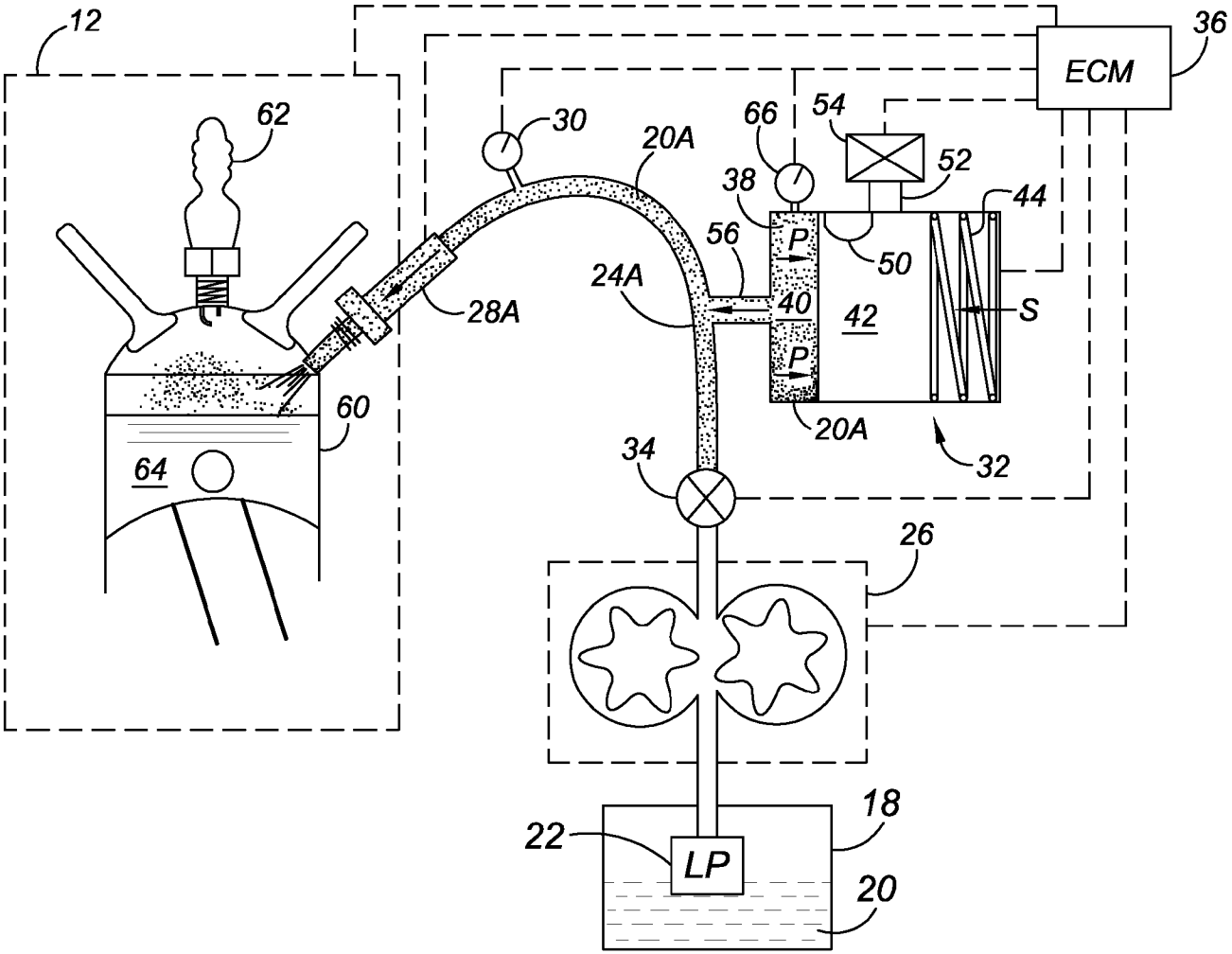
FIG. 3 is a schematic illustration of the starting system including the accumulator according to one embodiment of the present invention at engine start-up.

At engine start-up, as illustrated in FIG. 3, the valve 34 is in the closed position and the accumulator cavity 40 is filled with pressurized fuel 20A. Upon ignition, the ECM 36 is operable to determine which cylinder 60 of the engine 12 has a firing position closest to but not before a top dead center firing position. That is, the ECM 36 determines an actual firing position of each engine piston 64 within its respective cylinder 60 of the engine 12. The ECM 36 compares the actual firing position of each engine piston 64 to the top dead center firing position. The ECM 36 then determines the cylinder 60 with the actual firing position closest to but not before the top dead center firing position.

Based on the actual firing position of the cylinder 60 closest to the top dead center firing position, the ECM 36 is operable to determine a volume of air contained within the cylinder 60 closest to the top dead center firing position and adjust the amount of pressurized fuel 20A to be injected accordingly.

Upon such determination, the ECM 36 activates the solenoid 54 to disengage the pawl 52 from the accumulator piston 42, releasing the accumulator piston 42, allowing the spring force S to overcome the pressure force P. The accumulator piston 42 moves longitudinally within the accumulator cavity 40 forcing the appropriate amount of pressurized fuel 20A stored within the accumulator cavity 40 into the high-pressure fuel line 24A.

The pressurized fuel 20A is delivered from the high-pressure fuel line 24A to an injector 28A for injection into the determined cylinder 60 of the engine 12. The ECM 36 initiates a spark into the determined cylinder 60 via a spark plug 62 to generate a first starting combustion event to start the engine 12 without requiring a traditional starter.

If, however, the engine 12 does not start after the first starting combustion event or if the fuel pressure sensed by the fuel pressure sensor 30 is not sufficient, the ECM 36 is operable to generate subsequent starting combustion events based upon an accumulator pressure, sensed by an accumulator pressure sensor 66. Duration of the injection of the pressurized fuel 20A during the subsequent starting combustion events generated by the ECM 36 is adjusted based upon the sensed accumulator pressure.

Figure 4:
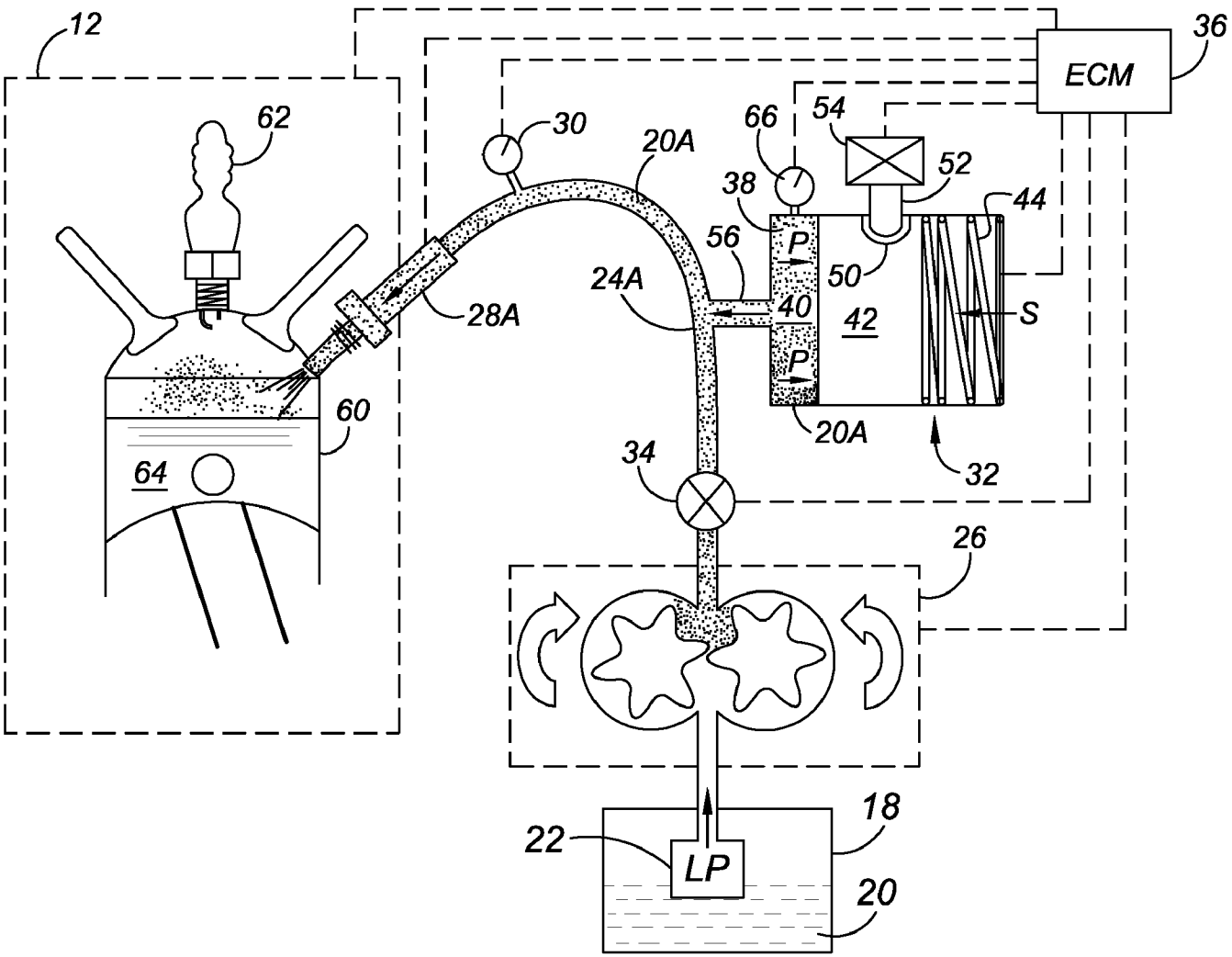
FIG. 4 is a schematic illustration of the starting system including the accumulator according to the embodiment of the present invention illustrated in FIG. 2 during engine operation.

Referring now to FIG. 4, once the engine 12 starts and sufficient fuel pressure is achieved, as determined by the fuel pressure sensed by the at least one fuel pressure sensor 30, the ECM 36 opens the valve 34 to deliver pressurized fuel 20A to the engine 12 for continued engine operation. At the same time, a portion of the pressurized fuel 20A enters the inlet/outlet port 56 to refill the accumulator cavity 40. The pressure force P of the pressurized fuel 20A, which is sufficient to overcome the accumulator spring force S, presses against the accumulator piston 42, moving the accumulator piston 42 longitudinally within the accumulator cavity 40, compressing the accumulator spring 44, and allowing the accumulator cavity 40 to fill with pressurized fuel 20A.

Once the accumulator cavity 40 is filled with pressurized fuel 20A, the ECM 36 activates the solenoid 54 to engage the pawl 52 with the pocket 50 of the accumulator piston 42, to hold the accumulator piston 42 in a fixed position, storing the pressurized fuel 20A within the accumulator 32 for use during the next engine start-up.

Figure 5:
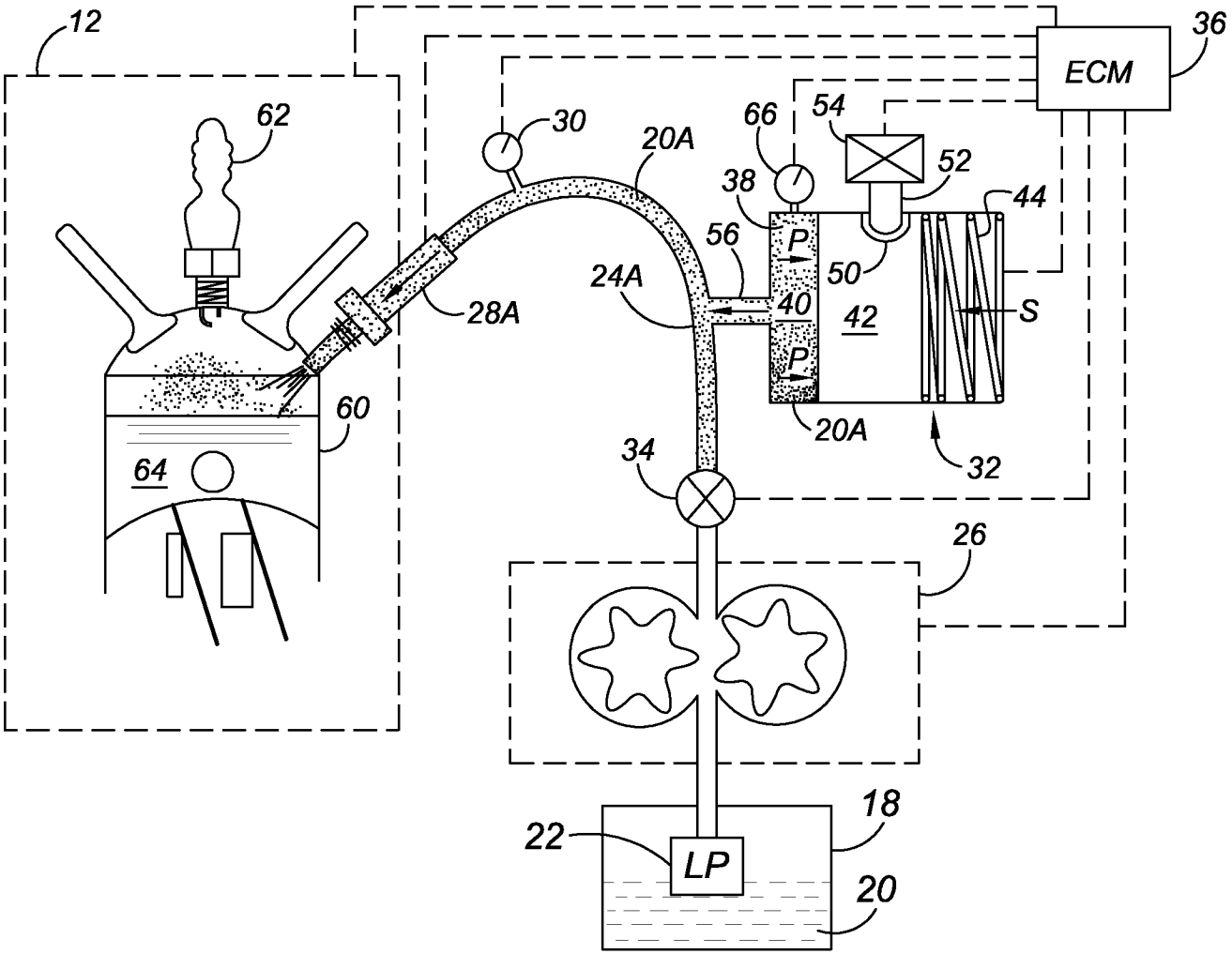
FIG. 5 is a schematic illustration of the starting system including the accumulator according to the embodiment of the present invention illustrated in FIG. 2 at engine shut-down.

Finally, upon engine shut-down, as illustrated in FIG. 5, the ECM 36 closes the valve 34 to prevent the pressurized fuel 20A stored within the accumulator 32 from flowing back to the low pressure fuel reservoir 18. The pressurized fuel 20A is stored within the accumulator 32 until a subsequent engine start-up is initiated by a user.

While the best modes for carrying out the invention have been described in detail, those familiar with the art to which this invention relates will recognize various alternative designs and embodiments for practicing the invention within the scope of the appended claims.

The invention claimed is:

1. A system for starting an internal combustion engine having a plurality of cylinders and being operable in a spark ignited direct injection mode comprising:

a fuel tank;

an accumulator;

a fuel pump in fluid communication with the fuel tank and the accumulator;

a plurality of injectors, each of the plurality of injectors being associated with a respective one of cylinders and in fluid communication with the accumulator;

a fuel pressure sensor;

an accumulator pressure sensor; and a control module that is configured to evaluate a firing position of each of the plurality of cylinders, determine which of the plurality of cylinders has the firing position closest to but not before a top dead center firing position, direct the accumulator to deliver fuel to the injectors, and cause the injector associated with the determined cylinder to inject fuel into the determined cylinder;

wherein the control module receives input from the fuel pressure sensor and the accumulator pressure sensor.

2. The system for starting an internal combustion engine as recited in claim 1, further including:

a fuel rail in fluid communication with the plurality of injectors; and wherein the fuel pressure sensor is configured to sense the pressure at the fuel rail.

3. The system for starting an internal combustion engine as recited in claim 1, wherein the control module is configured to adjust a duration of injection based upon the sensed accumulator pressure, and generates subsequent starting combustion events based on the sensed fuel pressure.

4. The system for starting an internal combustion engine as recited in claim 3, wherein the accumulator includes:

an accumulator piston and spring assembly; and an accumulator solenoid selectively engaging the accumulator piston and spring assembly, wherein the accumulator piston and spring assembly is disengaged when the engine is starting.

5. The system for starting an internal combustion engine as recited in claim 4, wherein a spring force associated with the accumulator piston and spring assembly forces fuel from the accumulator to feed the injector associated with the determined cylinder during engine start-up.

6. The system for starting an internal combustion engine as recited in claim 5, further including:

a valve positioned between the fuel pump and the accumulator, wherein the valve opens when the engine is running, the valve closes when the engine shuts down and the valve remains closed when the engine is stopped.

7. The system for starting an internal combustion engine as recited in claim 6, wherein the fuel pump is engine-driven.

8. A method of starting an internal combustion engine operable in a spark ignited direct injection mode without a starter, comprising the steps of:

determining an actual firing position of each of a plurality of cylinders when the engine is in a start-up mode;

associating the actual firing position with each of the plurality of cylinders;

selecting one of the plurality of cylinders based on the determined firing position;

sensing a fuel pressure in a fuel rail;

sensing an accumulator pressure;

determining an injection duration based upon the sensed accumulator pressure and the sensed fuel pressure;

injecting pressurized fuel for the determined duration and initiating a spark into the selected cylinder to generate a starting combustion event.

9. The method of starting an internal combustion engine as recited in claim 8, further including the steps of:

comparing each of the actual firing positions determined to a top dead center firing position; and selecting the one of the plurality of cylinders with the actual firing position closest to but not before the top dead center firing position.

10. The method of starting an internal combustion engine as recited in claim 9, further including the steps of:

determining a volume of air associated with the selected cylinder; and adjusting an amount of pressurized fuel to be injected based upon the determined volume of air.

* * * * *